United States Patent [19]

Jackson

[11] Patent Number: 4,518,494

[45] Date of Patent: May 21, 1985

[54] CLEANING DEVICE FOR INDUSTRIAL WATER INTAKES

[75] Inventor: Philip Jackson, Paris, France

[73] Assignee: E. Beaudrey & Cie, Paris, France

[21] Appl. No.: 482,795

[22] Filed: Apr. 7, 1983

[30] Foreign Application Priority Data

Apr. 8, 1982 [FR] France ..... 82 06209

[51] Int. Cl.[3] ..... B01D 33/02

[52] U.S. Cl. ..... 210/158; 210/159; 210/393

[58] Field of Search ..... 210/154, 158, 159, 160, 210/161, 162, 400, 526, 402, 408, 391, 393, 396, 326, 327, 407, 401, 406, 298, 413, 415; 209/379, 380, 381, 269, 270, 272, 308; 55/290

[56] References Cited

U.S. PATENT DOCUMENTS

| | | | |
|---|---|---|---|
| 1,585,461 | 5/1926 | Brackett | 210/158 |
| 1,910,860 | 5/1933 | Sayers | 210/160 |
| 2,060,896 | 11/1936 | Raisch | 210/391 |
| 3,037,632 | 6/1962 | Dujardin | 210/402 |
| 3,275,150 | 9/1966 | Tait | 210/403 |
| 4,186,091 | 1/1980 | Sutton | 210/158 |
| 4,360,369 | 11/1982 | Niederer | 55/290 |

FOREIGN PATENT DOCUMENTS

| | | | |
|---|---|---|---|
| 1325820 | 3/1963 | France | 210/402 |
| 921546 | 3/1963 | United Kingdom . | |

*Primary Examiner*—John Adee

*Attorney, Agent, or Firm*—Charles A. Brown; Charles E. Brown

[57] ABSTRACT

An industrial water intake comprising a screen for screening water and a spray nozzle for detaching deposited debris from the screen and entraining it into a debris recovery channel on the other side of the screen from the spray nozzle. A cylindrical rotary member comprising a roller is arranged along the adjacent longitudinal edge of the debris recover channel. The rotary member rotates in a direction tending to carry debris falling on or coming in contact with the longitudinal edge into the channel to prevent the build up of debris thereon. The rotary member extends above and is disposed inwardly of the longitudinal edge relative to the debris recovery channel. The rotary member is usable on recovery channels for band screens, drum screens or even bar screens associated with trash rakes.

15 Claims, 4 Drawing Figures

CLEANING DEVICE FOR INDUSTRIAL WATER INTAKES

BACKGROUND OF THE INVENTION

The invention relates generally to screens of the type commonly used for water intakes for supplying industrial plants or equipment, and more particularly, though not exclusively, to revolving screens such as drum screens and band screens.

Such water intakes are usually installed along the bank of a waterway or at the sea coast. The water inevitably entrains, in variable amounts, numerous foreign bodies, manmade waste, industrial refuse, and debris and organisms of natural origin such as leaves, grass, branches, fish, and algae.

Before use of such water in industrial plants or a piece equipment the water is screened, first by passing through a bar screen and then through a revolving screen. The revolving screen may, for example, be a band screen comprising a screen band including a series of articulated screen panels arranged in an endless loop or a drum screen which may also comprise a series of screen panels which together form the cylindrical sidewall of the drum.

Revolving screens may be disposed transversely with respect to the direction of the flow of the water in the sluice in which case the generatrices of the screen band or screen drum are substantially perpendicular to the direction of flow or they may be disposed parallel to the direction of flow of the water in the sluice in which case the generatrices of the screen band are substantially parallel to the direction of flow.

In so-called flow-through band screens the band screen disposed transversely with respect to the direction of the flow of water in the sluice extends across the entire width of the sluice and the water passes successively through an upstream run and a downstream run of the screen before continuing on toward the plant or piece of equipment in which it is to be used.

Debris held back by the screen is deposited on the upstream or exterior surface of the upstream run of screen.

In an other type of band screens called a dual-flow band screen the water to be screened simultaneously passes through both runs of the screen and depending on the selected direction of the flow of water through the screen the debris held back is deposited on the exterior or interior surface of the screen.

The advantages of the different types of revolving screen and various arrangements threof are known to those skilled in the art and need not be developed herein.

Whatever the type of revolving screen, the screen element becomes clogged during its immersion in the sluice and the rotation of the screen brings the clogged elements in line with a cleaning or washing device disposed at the top, emersed part of the screen and typically comprises at least one spray nozzle disposed on a first side of the screen element opposite the side on which the debris clogging the same is deposited and adapted to spray a jet of liquid toward the screen element, in practice in the form or a flat spray or jet. A debris recovery member, usually a channel, is associated with the cleaning or washing device and is adapted to collect the debris which the sprayed liquid has removed from the screen element. There is inevitably a gap between the screen element and the debris recovery channel, especially in band screens, to compensate for the sway of the screen band in operation.

Such cleaning or washing devices are adapted to remove debris from the rising or descending run of the screen element when the cleaning or washing device is disposed along the emersed part of the rising run of the screen element.

As soon as it is touched by the lower generatrice or edge of the liquid spray, it falls, under the force of gravity, between the screen element and the edge of the debris recovery channel. In particular when the debris deposited on the screen element forms a layer which is unstuck in a single mass or comprises large leaves, filaments or especially algae, the liquid spray entrains the debris against the side or edge of the recovery channel to which it becomes attached and builds up dangerously.

If the cleaning or washing device is disposed along the descending run or side of the screen element, the detached debris falls on the liquid spray and is carried into the debris recovery channel. However, debris which comprises relatively heavy pieces, debris having a large surface area (plastic film or sheets), or comprising long strips such as algae which escapes the liquid spray falls and/or attaches itself to the edge or lip of the debris recovery channel. The consequent build-up of debris on the edge build-up is all the more dangerous as the displacement of the screen panels downwards past the debris recovery channel increases the stuffing up of the gap between the screen element and the debris recovery channel.

Now, particularly when the water intake has to handle water carrying large amounts of debris, for example, algae, the removal of the debris must be effected continuously and any build-up anywhere along the debris recovery device, and in particular in the debris recovery channel, may jam the screen, putting it out of order. Likewise, the stuffing up of the gap between the edge or side of the debris recovery channel and the filter element may seriously damage the device and cause the stoppage of the screen.

DESCRIPTION OF PRIOR ART

In British Pat. No. 921,546 a bar screen is disclosed having a reciprocating rake mechanism adapted to periodically remove debris which has accumulated thereagainst. When the rake reaches its point of reversal the refuse from the rake is swept into a receiver by a rotary sweeping brush.

In French Pat. No. 73 46681 (publication No. 2,255,802) a culvert carrying water to a plant has a slatted conveyor extending upwardly from the level of the water in the culvert and carrying leaves and other debris upwards out of the water, and spray nozzles detach the debris from the slotted conveyor and it falls into an evacuation channel. In addition a scraper is provided on the edge of the culvert for mechanically detaching the debris from the conveyor.

In French Pat. No. 505,629 a rake cleans a bar screen and the vibrations of the apparatus cause the debris to fall into a channel having a screw conveyor for carrying the debris to a dump.

None of these prior art publications discloses means which prevent the build-up of debris on the longitudinal edge of a debris recovery channel associated with a screen.

SUMMARY OF THE INVENTION

A general object of the invention is to provide a device which avoids debris detached from a filter element becoming attached to and building up on the lip or edge of an associated debris recovery channel.

A more specific object of the invention is the provision of a cylindrical rotary member which extends along the longitudinal edge or lip adjacent the screen element for carrying detached debris which would otherwise build up on the longitudinal edge inside the debris recovery channel.

According to one aspect of the invention there is provided an industrial water intake of the type comprising a screen for screening water containing debris adapted to be deposited on the screen in the course of operation. Means are provided for detaching the debris from the screen. A debris recovery channel collects debris detached from the screen and carries it away from the water intake. The debris recovery channel has a longitudinal edge relatively adjacent to the screen. According to the improvement of the invention a cylindrical rotary member is disposed adjacent to and extends along the entire longitudinal edge of the debris recovery channel and means rotate the rotary member in a direction tending to carry debris falling on the longitudinal edge into the debris on the said longitudinal edge.

According to a second aspect of the invention an industrial water intake is provided comprising a revolving screen for screening water containing debris adapted to be deposited on the screen in the course of operation. A spray nozzle directs a liquid spray at a surface of the revolving screen opposite the surface on which debris is adapted to be deposited for detaching debris from the screen and carrying it toward a debris recovery channel. The longitudinal edge of the debris recovery channel extends along the width of the revolving screen and is spaced therefrom to define a gap. According to the improvement of the invention a cylindrical rotary member extends along the entire longitudinal edge and at least partly thereabove, and means rotates the rotary member in a direction tending to carry debris falling on the longitudinal edge into the debris recovery channel thereby preventing the build-up of debris on the longitudinal edge.

The cylindrical rotary member prevents debris which escapes the liquid spray becoming attached anywhere along the edge of the channel by carrying such debris into the debris recovery channel, thereby effectively remedying the heretofore inevitable and dangerous build-up of debris along the edge of the debris recovery channel.

The features and advantages of the invention will be brought out in the description of the invention which follows, given by way of example, with reference to the accompanying diagrammatic drawings.

DESCRIPTION OF THE PREFERRED EMBODIMENT

Figure 1:
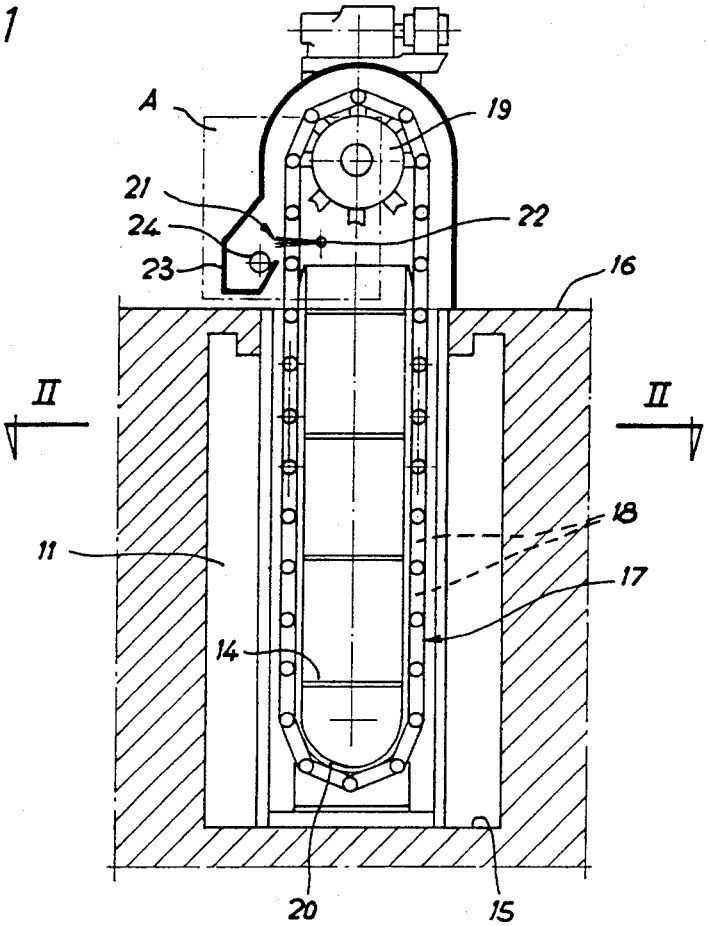
FIG. 1 is an elevational sectional view of a dual-flow band screen arranged in a sluice taken along line I—I in FIG. 2, including the novel rotary member associated with the edge of the recovery channel adjacent the screen.
Figure 2:
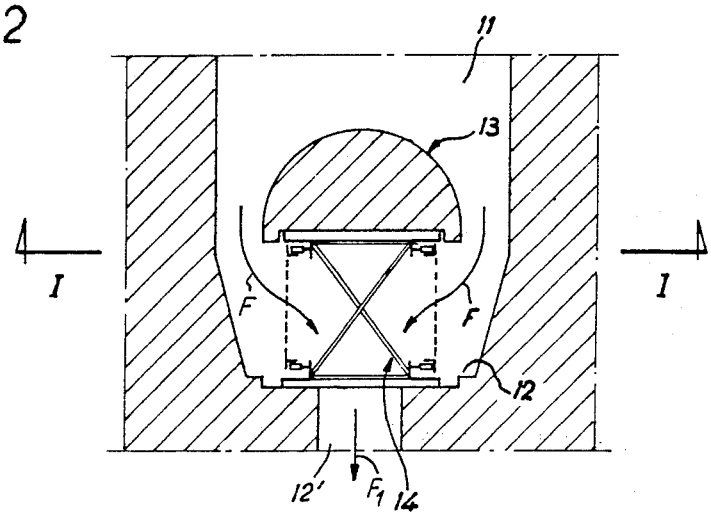
FIG. 2 is a horizontal sectional view of the band screen of FIG. 1 taken along line II—II in FIG. 1.
Figure 4:
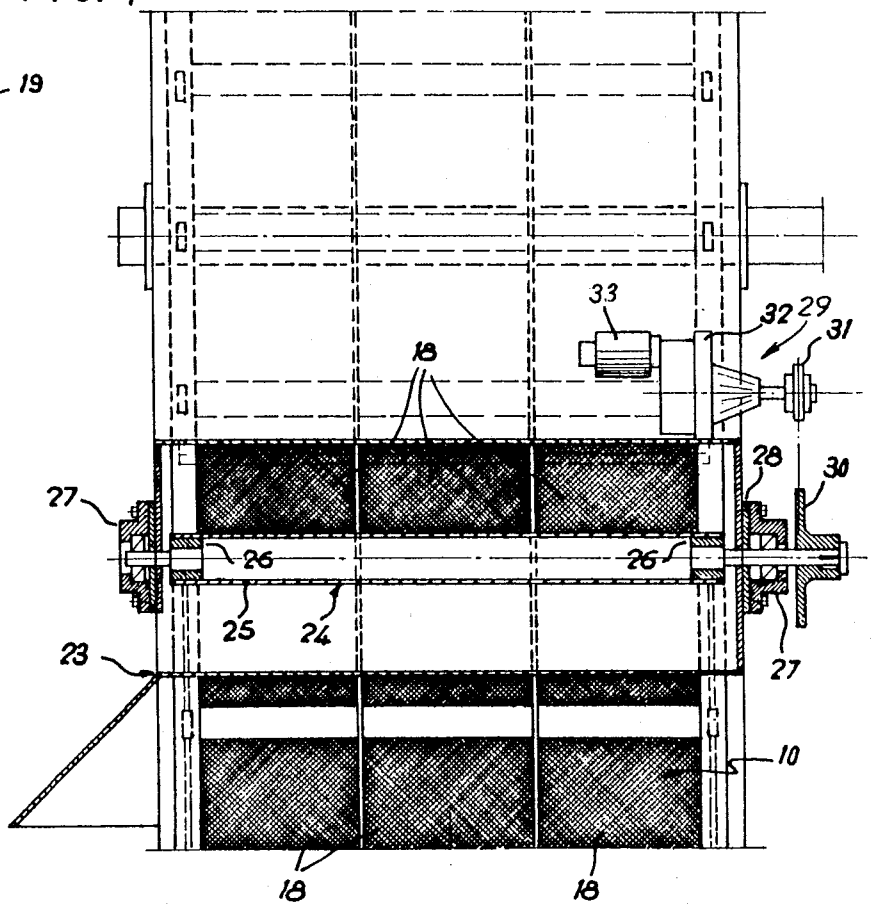
FIG. 4 is a cross-sectional view of the part of the band screen taken along line IV—IV in FIG. 3.

The drawings illustrate by way of example the application of the present invention ot a dual flow band screen 10 installed in a sluice 11 of a water intake, the water flowing inside the contour of the screen band through each of the runs of the screen band as indicated by arrows F in FIG. 2. The band screen 10 extends substantially vertically along the wall 12 of the sluice between the pierhead 13 facing wall 12 and the latter. The screened water exits the sluice through an opening 12' in wall 12 as indicated by arrow $F_1$ and is carried by a conduit or pipe to the piece of equipment or plant (not shown) in which it is to be used.

The band screen 10 comprises a support structure 14 which is, for example, carried by the bottom wall 15 of the sluice and extends from the bottom wall 15 to above the top wall 16 of the sluice 16. The band screen 10 comprises a screen element or screen band 17 including in practice a series of articulated screen panels 18 attached to one another in the form of an endless loop around extending, for example, an upper driving sprocket 19 and a fixed lower guide 20, although other arrangements known to those skilled in the art may be adopted.

The various components and details of the support structure, the screen band, the screen panels which make up the screen band, and the drive and guide means therefore are known per se and therefore need not be described in detail herein.

The band filter 10 comprises at its upper end above the high water level in the sluice, a cleaning or washing device 21 which continuously cleans the panels of the screen band which become clogged while the screen band is immersed. The cleaning device 21 comprises a spray nozzle 22 facing the surfaces of one run, here the descending run, of the screen band opposite the surface thereof on which debris has been deposited. In the case of the band screen illustrated the spray nozzle is directed at the inner surface of the descending run of the screen band. The spray nozzle 22 extends transversely with respect to the screen band 17 and across the entire width thereof and is adapted to spray liquid toward the screen band in the from of a flat spray along a generatrice of the screen band. A debris recovery or collecting member 23 is disposed on the other side of the screen band 17 remote from the spray nozzle 22 and is adapted to collect the debris detached from the screen band by the liquid spray.

In the illustrated embodiment the debris recovery member 23 comprises a channel fixed to the support structure of the band filter, though alternatively it may be arranged in the masonry structure of the upper wall 16 of the sluice.

Figure 3:
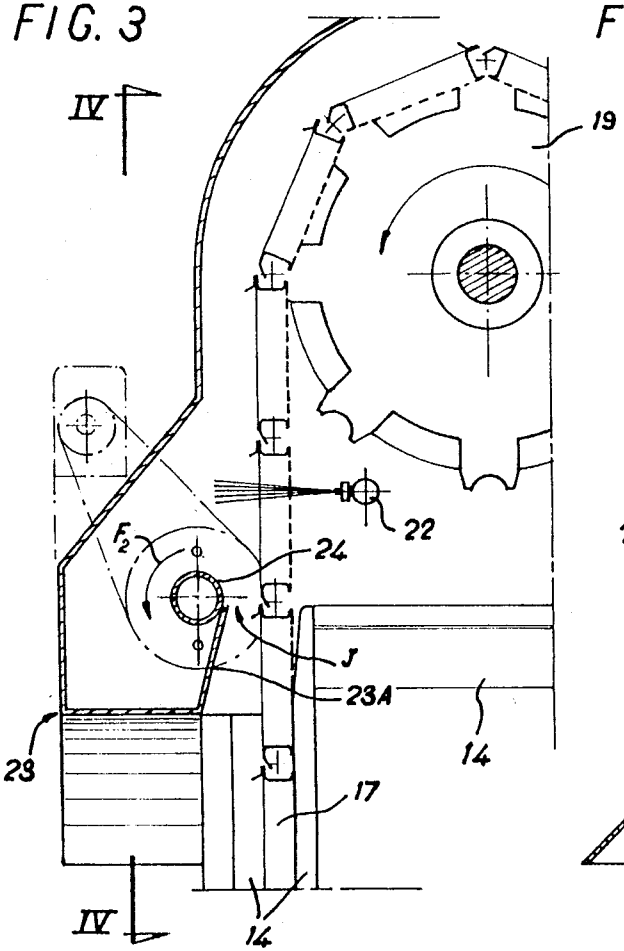
FIG. 3 is an enlarged-scale fragmentary view of the part of the band screen enclosed in chain-line box A in FIG. 1.

As shown best in FIG. 3 a gap J is inevitably provided in construction between longitudinal edge 23A of the debris recovery channel 23 adjacent the screen band and the facing part of the screen band.

According to the invention a cylindrical rotary member is mounted for rotation adjacent the edge 23A of debris recovery channel 23 and extends along the entire length of longitudinal edge 23A for carrying debris detached from the screen band inside the debris recovery channel 23, so as to prevent the debris from permanently attaching itself to the edge 23 and building up thereon.

In the illustrated embodiment the cylindrical rotary member comprises a hollow roller 25 of stainless steel having opposite end fittings 26 also of stainless steel. Each end of the roller 27 is rotatably mounted in a ball bearing 27, by spindles extending from the respective end fittings 26. A mounting plate 28 facilitates the mounting of the ball bearings on the endwalls of the debris recovery channel 23. Drive means 29 are provided for the roller 27. As shown the recovery channel 23 forms part of a housing covering the top part of the band screen extending out of the masonry structure forming the sluice at one end thereof as shown and comprise in the preferred embodiment a driven sprocket 30 fixed to the spindle extending from one end fitting 20 corresponding to the upstream end of the debris recovery channel 23. The drive means 29 further comprise a motor 33, a gear reduction unit 32 having a driving sprocket 31 fixed to its output shaft, a chain extending around sprockets 31 and 30 transmitting torque to the roller 24. The roller 27 rotates in the direction indicated by arrow $F_2$ in FIG. 3.

As the band panels 18 pass by the spray nozzle 22 the debris which is detached by the liquid spray but escapes from the liquid spray falls in the gap J between the screen band 17 and the debris recovery channel 23, attaching itself at the edge 23A of the debris recovery channel. Owing to the roller 24, which rotates in the direction indicated by arrow $F_2$, such debris which would otherwise build up on the edge 23A of the debris recovery channel falls on or otherwise comes into contact with the roller 24 and is systematically carried inside the debris recovery channel 23. The debris is continuously or intermittently flushed downstream of the debris recovery channel 23 away from the water intake.

The roller 24 of the cylindrical rotary member has a smooth cylindrical surface in the illustrated embodiment. However, to improve adherence and facilitate the transfer of debris inside the debris recovery channel 23 the surface of the roller may be roughened or comprise spikes for example.

The invention has been described with respect to a dual-flow band screen in which incoming water flows inwardly through the both runs of the screen. But the invention is adapted to be fitted on all types of revolving screens including, inter alia, flow-through band screens, and drum screens.

Such an arrangement may also advantageously equip the longitudinal edge of a debris recovery channel associated with a mechanical trash rake for detaching debris from a stationary bar screen wherein the debris removed from the screen by the rake is dumped into the debris recovery channel at the top end of the path of movement of the trash rake.

In the present invention the cylindrical rotary member is at all times spaced from the pathway of the screen band and out of contact with the same. Accordingly it may be used with debris recovery channels associated with any kind of moving or stationary screen for a water intake irrespective to the constructional features of such a screen. The present invention is therefore useful wherever debris is removed from a screen whether by a cleaning device such as a spray nozzle or a trash rake and falls or is dropped into an associated debris recovery channel.

What I claim is:

1. In an industrial water intake of the type comprising a screen for screening water containing debris adapted to be deposited on said screen in the course of operation, spray means for detaching debris from said screen arranged on one side thereof, a debris recovery channel arranged below said spray means for detaching debris from said screen and on the other side of said screen from said means for collecting debris detached from said screen and for carrying the debris away from said water intake, said debris recovery channel having a longitudinal edge relatively adjacent to said screen, wherein the improvement comprises a cylindrical rotary member disposed adjacent to and extending along the entire longitudinal edge of said debris recovery channel, at least a portion of said rotary member extending above said longitudinal edge of said debris recovery channel, means for rotating said rotary member in a direction to carry debris falling toward said longitudinal edge away from said longitudinal edge and into said debris recovery channel thereby preventing the build-up of debris on said longitudinal edge.

2. The invention of claim 1, wherein said cylindrical rotary member is disposed generally inwardly of said longitudinal edge relative to said debris recovery channel.

3. The invention of claim 1, wherein said means for rotating said rotary member comprises motor means drivingly connected to one end of said rotary member.

4. The invention of claim 3, wherein said one end corresponds to the upstream end of said debris recovery channel relative to direction in which collected debris is carried away.

5. The invention of claim 1, wherein said rotary member comprises a roller.

6. The invention of claim 1, wherein said rotary member comprises a roller having a roughened surface for improving adherence of debris thereto.

7. The invention of claim 1, wherein said rotary member comprises a roller having spikes for improving the adherence of debris thereto.

8. The invention of claim 1, wherein said screen comprises a revolving screen element, said spray means for detaching debris from said screen comprising a spray nozzle for directing a liquid spray at the surface of said screen element opposite the surface thereof on which debris is adapted to be deposited.

9. The invention of claim 8, wherein said rotary member is mounted for rotation about an axis at a level below the level of said spray nozzle.

10. The invention of claim 8, wherein said longitudinal edge is spaced from said screen element so as to define a gap therebetween, said rotary member being operative to prevent the build up of debris in said gap.

11. The invention of claim 8, wherein said debris recovery channel comprises part of a housing enclosing the upper end of said revolving screen above the high water level in said water intake.

12. The invention of claim 8, wherein said spray nozzle is disposed inside the contour of said revolving screen element for detaching debris adhering to the outer surface of said screen element and entraining it toward said debris recovery channel.

13. The invention of claim 1, wherein said rotary member is arranged close enough to said longitudinal edge to remove debris temporarily adhering thereto and carrying it inside said debris recovery channel.

14. An industrial water intake comprising a revolving screen for screening water containing debris adapted to be deposited on said screen in the course of operation, a spray nozzle for directing a liquid spray at the surface of said revolving screen opposite the surface of which debris is adapted to adhere for detaching the debris therefrom and carrying toward a debris recovery channel, said debris recovery channel being disposed below the spray nozzle and on the side of the screen remote from said spray nozzle having a longitudinal edge extending along the width of said revolving screen, said longitudinal edge being spaced from said revolving screen to define a gap therebetween, wherein the improvement comprises a cylindrical rotary member extending along the entire longitudinal edge and at least partly thereabove, means for rotating said rotary member in a direction tending to carry debris falling on said longitudinal edge away from said edge and into said debris recovery channel thereby preventing the build-up of debris on said longtiudinal edge.

15. The water intake of claim 14, wherein said revolving screen is a band screen.

* * * * *